US011891817B2

(12) United States Patent
Perra

(10) Patent No.: US 11,891,817 B2
(45) Date of Patent: Feb. 6, 2024

(54) FLOOR PANEL AND FLOOR

(71) Applicant: I4F Licensing NV, Hamont-Achel (BE)

(72) Inventor: Antonio Giuseppe Perra, Bergen (NL)

(73) Assignee: i4F Licensing NV, Turnhout (BE)

( * ) Notice: Subject to any disclaimer, the term of this patent is extended or adjusted under 35 U.S.C. 154(b) by 0 days.

(21) Appl. No.: 17/639,380

(22) PCT Filed: Sep. 6, 2019

(86) PCT No.: PCT/NL2019/050581

§ 371 (c)(1),
(2) Date: Mar. 1, 2022

(87) PCT Pub. No.: WO2021/045612

PCT Pub. Date: Mar. 11, 2021

(65) Prior Publication Data

US 2022/0325531 A1 Oct. 13, 2022

(51) Int. Cl.

| | |
|---|---|
| ***E04F 15/02*** | (2006.01) |
| ***E04F 15/10*** | (2006.01) |
| ***E04F 13/08*** | (2006.01) |

(52) U.S. Cl.

CPC .... *E04F 15/02038* (2013.01); *E04F 13/0894* (2013.01); *E04F 15/10* (2013.01);
(Continued)

(58) Field of Classification Search

CPC ..... E04F 15/02038; E04F 15/10; E04F 2201/023; E04F 2201/027; E04F 15/102;
(Continued)

(56) References Cited

U.S. PATENT DOCUMENTS 444,042 A * 1/1891 Brock ..... E04F 13/10 52/592.1
2,328,051 A * 8/1943 Bull ..... E04B 2/7457 52/592.1

(Continued)

FOREIGN PATENT DOCUMENTS

CN 101558210 A 10/2009
CN 107075858 A 8/2017

(Continued)

*Primary Examiner* — Brent W Herring
(74) *Attorney, Agent, or Firm* — The Webb Law Firm

(57) ABSTRACT

The present invention relates to a floor panel and to a floor. The floor panel according to the invention includes a core provided with an upper and lower surface, and a first and second core flank at a first and second side of the core, respectively. The floor panel includes a first coupling part and a second coupling part provided at the first side and the second side of the core, respectively. Each of the coupling parts includes an inner side flank, an outer side flank, and an upper portion flank connecting the inner side flank to the outer side flank. According to the invention, a portion of the first core flank and an upper portion of the outer side flank of the second coupling part are inclined such that when the floor panel is coupled to an adjacently arranged further floor panel these upper portions lie against each other for the purpose of providing a locking in a vertical direction. In addition, a first upper portion flank of the tongue of the first coupling part includes a curved recess and the groove of the second coupling part may include a bulge complimentary to the curved recess.

23 Claims, 8 Drawing Sheets

(52) U.S. Cl.
CPC ..... *E04F 15/102* (2013.01); *E04F 15/105* (2013.01); *E04F 2201/0107* (2013.01); *E04F 2201/0146* (2013.01); *E04F 2201/023* (2013.01); *E04F 2201/026* (2013.01); *E04F 2201/027* (2013.01); *E04F 2201/03* (2013.01); *E04F 2201/043* (2013.01)

(58) Field of Classification Search
CPC ..... E04F 15/105; E04F 2201/0107; E04F 2201/0138; E04F 2201/042; E04F 2201/043; E04F 13/0894; E04F 2201/0146; E04F 2201/03; E04F 2201/026
USPC ..... 52/588.1, 589.1
See application file for complete search history.

(56) References Cited

U.S. PATENT DOCUMENTS 4,426,820 A * 1/1984 Terbrack ..... E04F 15/10 52/590.1
6,763,643 B1 * 7/2004 Mårtensson ..... E04F 15/04 52/582.1
8,281,549 B2 * 10/2012 Du ..... E04F 15/02038 52/591.1
8,528,290 B2 9/2013 Oh
8,544,231 B2 * 10/2013 Hannig ..... E04F 15/02 52/592.1
9,217,250 B2 12/2015 Perra et al.
10,704,269 B2 * 7/2020 Whispell ..... E04F 15/105
11,208,814 B2 12/2021 De Rick
11,319,712 B2 5/2022 Hannig
2005/0028474 A1 * 2/2005 Kim ..... E04F 15/04 52/578
2008/0104921 A1 * 5/2008 Pervan ..... E04F 15/08 52/588.1
2012/0067461 A1 3/2012 Braun
2013/0152492 A1 * 6/2013 Whitaker ..... E04F 15/02016 52/173.3
2013/0309441 A1 * 11/2013 Hannig ..... F16B 5/0056 29/428
2016/0201336 A1 * 7/2016 Pervan ..... E04F 15/02038 52/582.2
2017/0030088 A1 * 2/2017 Simoens ..... E04F 15/107
2017/0067261 A1 3/2017 Hannig et al.
2017/0284105 A1 * 10/2017 Ceysson ..... E04F 15/105
2018/0010342 A1 * 1/2018 Van Hooydonck ... E04F 15/105
2018/0216353 A1 * 8/2018 Hannig ..... E04F 15/02033
2019/0024386 A1 1/2019 Choi
2019/0218793 A1 7/2019 Ceysson et al.
2020/0340254 A1 * 10/2020 De Rick ..... E04F 15/107
2020/0378136 A1 * 12/2020 Hannig ..... E04F 13/0894
2021/0381254 A1 * 12/2021 Boucké ..... E04F 15/105

FOREIGN PATENT DOCUMENTS

EP 1380710 A2 1/2004
EP 2440724 B1 5/2014
EP 3031998 A1 6/2016
JP 2018509538 A 4/2018
KR 1020160104515 A 9/2016
WO 2019138365 A1 7/2019

* cited by examiner

FLOOR PANEL AND FLOOR

CROSS-REFERENCE TO RELATED APPLICATION

This application is the United States national phase of International Application No. PCT/NL2019/050581 filed Sep. 6, 2019, the disclosure of which is hereby incorporated by reference in its entirety.

BACKGROUND OF THE INVENTION

Field of the Invention

The present invention relates to a floor panel and to a floor. In particular, the present invention relates to a laminated floor panel. The present invention particularly relates to floor panel that comprises coupling structures to enable a so-called tongue and groove coupling with an adjacently arranged identical floor panel.

Description of Related Art

An example of such a floor panel is known from EP3031998B1.

The known floor panel comprises a core that is provided with an upper surface, a lower surface, a first core flank at a first side of the core, and a second core flank at a second side of the core. The first core flank comprises a first core flank upper portion that connects to the upper surface. The known floor panel further comprises a first coupling part and a second coupling part provided at the first side and the second side of the core, respectively.

The first coupling part of the known floor panel comprises a first tongue having a first inner side flank, a first outer side flank, and a first upper portion flank connecting the first inner side flank to the first outer side flank. The first coupling part further comprises a first bridging part connecting the first tongue to the core.

Similarly, the second coupling part of the known floor panel comprises a second tongue having a second inner side flank, a second outer side flank, and a second upper portion flank connecting the second inner side flank to the second outer side flank, wherein the second outer side flank comprises a second outer side flank upper portion that connects to the upper surface. The second coupling part further comprises a second bridging part connecting the second tongue to the core.

The first inner side flank, the first bridging part, and the first core flank define a first groove and the second inner side flank, the second bridging part, and the second core flank define a second groove.

The known floor panel is configured to be coupled to an adjacently arranged further floor panel that is identical to said floor panel in such a manner that the first tongue of the floor panel is received in the second groove of the adjacently arranged further floor panel and that the second tongue of the adjacently arranged further floor panel is received in the first groove of the floor panel thereby providing a first locking in a first direction substantially parallel to the upper surface. Here, the first direction typically corresponds to a horizontal direction.

Conventional floor panels, such as the known floor panel described above, are not without drawbacks. For example, a user needs to exert a certain amount of force to enable the coupling between a floor panel and an adjacently arranged floor panel. More in particular, the amount of coupling force that exists between adjacent floor panels is related to the force required by the user to couple these floor panels. Put differently, if floor panels can be easily coupled they may also be more likely to detach from each other under the influence of heat and/or humidity. Such detachment or loosening may result in the familiar problems of these types of floor panels, such as floor panels forming a bulge, or grooves between adjacent floor panel becoming too large.

In the art, focus has therefore been on realizing strong coupling forces between adjacent floor panels. For example, in the known floor panel described above, a locking element in the form of a protruding bulge on the first outer side flank is used that is configured to cooperate with a recess in the second core flank of an adjacently arranged floor panel.

When trying to couple adjacent floor panels, a risk exists in that by applying the force required to couple the floor panels, delicate structures of these floor panels may get damaged. When a floor panel gets damaged, the coupling with other floor panels and/or the optical appearance of the floor panel may deteriorate.

SUMMARY OF THE INVENTION

An object of the present invention is to provide a floor panel in which the abovementioned problems do not occur or at least to a lesser extent.

According to the present invention, this object is achieved with the floor panel that is characterized in that at least a part of the first core flank upper portion of the first core flank and at least a part of the second outer side flank upper portion of the second outer side flank are inclined such that when the floor panel is coupled to the adjacently arranged further floor panel these upper portions lie against each other for the purpose of providing a second locking in a second direction substantially perpendicular to the upper surface. In addition, the first upper portion flank of the first tongue comprises a curved recess that connects to the first inner side flank at a first angle in between 90° and 150°, wherein the first inner side flank extends from the curved recess towards the first bridging part and towards the core, and wherein the second groove preferably comprises a bulge that is shaped substantially complementary to the curved recess and is configured such that it is received in the curved recess when the floor panel is coupled to the adjacently arranged further floor panel.

Compared to other known floor panels, such as the floor panel described in EP2440724B1, a vertical locking, corresponding to the abovementioned locking in the second direction, is not achieved through cooperation between the first inner side flank and the second inner side flank. On the contrary, the first inner side flank is inclined towards the core when viewed from the top of the first tongue.

Furthermore, a curved recess is provided in the first upper portion flank of the first tongue. When arranging a further floor panel next to a floor panel, the second tongue of the further floor panel may be supported in the curved recess prior to the user applying the force required to couple the floor panels. Accordingly, when the user moves the floor panels into alignment he or she will notice that the further floor panel will display a slight drop when the second tongue of the further floor panel engages the curved recess of the floor panel. This will alert the user that the further floor panel is close to a position in which more force is required.

The inclined first inner side flank provides a supporting surface that supports the further floor panel when it moves towards its final position relative to the floor panel. The vertical coupling is achieved on a different flank so as not disturb the supporting of the further floor panel.

The Applicant has found that the combination of the curved recess, the inclined first inner side flank, and the vertical locking achieved using the cooperation between the first core flank upper portion of the floor panel and the second outer side flank upper portion of the further floor panel provides a reliable and convenient locking of adjacent floor panels with considerably less risk of imparting damage to the floor panels during floor assembly. More in particular, the user is assisted in finding a reliable position of the floor panel relative to the further floor panel so that the risk of damaging the floor panel(s) caused by the use of force when the floor panels are not properly aligned is avoided. At the same time, a vertical locking between these floor panels can be realized.

An end of the curved recess that is closest to the core can be above a lowest part of the curved recess relative to the lower surface. Hence, relative to the lower surface, the curved recess may be curved upwardly at the end when viewed from the first tongue toward the core. This will result in a further locking in the first direction provided that the bulge of the second groove is shaped complementarily to the curved recess.

The inclined part of the second outer side flank upper portion of the second outer side flank may comprise a first outer point that is arranged farthest away from a central part of the core in the first direction. The inclined part of the first core flank upper portion of the first core flank may comprise an inner point, and a second outer point that is arranged farthest away from a central part of the core in a third direction, wherein the third direction is substantially opposite to the first direction. The floor panel may be configured such that when the second upper portion flank of the second tongue of the adjacently arranged further floor panel is arranged in the curved recess of the floor panel prior to coupling said floor panel to said adjacently arranged further floor panel and is moved in the first direction, the first outer point of the adjacently arranged further floor panel slides underneath the second outer point of the floor panel towards the inner point of the floor panel.

Typically, the outer points of the coupling parts are the weakest points of the floor panels. By arranging the floor panel in the manner described above, it is ensured that the first outer point of the further floor panel will not contact the second outer point of the floor panel when the user applies the required force to couple the panels. Consequently, damaging the floor panel(s) at the first and second outer points can be avoided or reduced.

During the sliding movement of the first outer point of the adjacently arranged further floor panel towards the inner point of the floor panel, the second upper portion flank of the adjacently arranged further floor panel can be guided by the first inner side flank of the floor panel, and the floor panel can be configured such that when the second upper portion flank of the second tongue of the adjacently arranged further floor panel is arranged in the curved recess of the floor panel just before or at the moment the second upper portion flank will be guided by the first inner side flank of the floor panel, the bulge of the adjacently arranged further floor panel is guided by the curved recess of the floor panel. Due to its shape, the bulge can withstand a relatively strong force without the risk of getting damaged. The guiding properties of the first inner side flank can be further improved if the first inner side flank extends from the curved recess towards the first bridging part and towards the core at a second angle (β) relative to a normal of the lower surface that is between 0° and 45°, more preferably between 10° and 30°.

The first outer side flank may comprise a first locking element and the second core flank may comprise a second locking element, wherein the first locking element and the second locking element are configured such that when the floor panel is coupled to the adjacently arranged further floor panel the first locking element of the floor panel cooperates with the second locking element of the adjacently arranged further floor panel for the purpose of providing a third locking in the second direction.

The second locking element may extend in the second direction from a second locking element start part up to a second locking element end part. The second inner side flank may comprise a second inner side flank end at which the second inner side flank is coupled to the second upper portion flank. In this case, the second locking element end part and the second inner side flank end are at a substantially equal distance to the upper surface. Additionally or alternatively, the second core flank may further comprise an inclined sub second core flank arranged in between the lower surface and the second locking element start part and extending under a fifth angle (δ) relative to a normal of the lower surface, wherein the fifth angle is in between 0° and 60°.

The first and second locking elements may comprise a bulge and a recess having a shape that is complementary to the shape of the bulge, or vice versa.

The first core flank upper portion may extend under a third angle (γ1) relative to a normal of the lower surface and the second outer side flank upper portion may extend under a fourth angle (γ2) relative to the normal (N1) of the lower surface, wherein both the third and fourth angles (γ1, γ2) are in between 0° and 30°. More in particular, the third angle can be at least substantially equal to the fourth angle, and preferably larger than the fourth angle by an angle in between 0° and 5°. By having the third angle larger than the fourth angle, a slight deformation will occur when the second tongue enters the first groove. Such deformation may add to the strength of the coupling between the floor panels.

The lengths of the first core flank upper portion, the first inner side flank, the second inner side flank, and the second outer side flank upper portion can be substantially equal.

The first bridging part may comprise at least a first bridging flank and a second bridging flank, wherein the first bridging flank can be coupled with the first inner side flank and the second bridging part, and wherein the second bridging part can be coupled with the first core flank.

The second upper portion flank may comprise a first flank segment and a second flank segment, wherein the first flank segment can be coupled with the second inner side flank and the second flank segment, and wherein the second flank segment can be coupled with the second outer side flank.

The first bridging flank and the first flank segment can be substantially flat and/or the second bridging flank and the second flank segment can be substantially flat. Alternatively, the first bridging flank and the first flank segment can be curved and/or the second bridging flank and the second flank segment can be curved. Additionally or alternatively, the first bridging flank and the first flank segment can be complementarily shaped and/or the second bridging flank and the second flank segment can be complementarily shaped.

The curved recess may occupy at most half of an entire surface of the first upper portion flank of the first upper tongue.

The first upper portion flank may further comprise a bulge and/or a substantially flat flank segment. In some embodiments, the first upper portion consists of the bulge and the substantially flank segment. For example, the bulge of the first upper portion flank may be connected to the first outer side flank and the flat flank segment, and the flat flank segment may be connected to the bulge and to the curved recess. However, the bulge of the first upper portion flank may alternatively be connected to the curved recess and to the flat flank segment, wherein the flat flank segment is connected to the bulge and the first outer side flank. In addition, first upper portion flank may comprise only one of a bulge and a substantially flat flank.

Additionally, the second groove may further comprise a recess and/or a substantially flat flank segment. Moreover, the bulge and/or substantially flat flank segment of the first upper portion flank and the recess and/or substantially flat flank segment of the second groove can be complementarily shaped.

The first locking element may extend in the second direction from a first locking element start part up to a second locking element end part. Furthermore, the first outer side flank may further comprise an inclined sub first outer side flank that is arranged in between the first locking element start part and the lower surface and may extend under a sixth angle (ε) relative to a normal of the lower surface, wherein the sixth angle is in between 0° and 60°.

The first core flank may comprise a third locking element and the second outer side flank may comprise a fourth locking element, wherein the third locking element and the fourth locking element are configured such that when the floor panel is coupled to the adjacently arranged further floor panel the third locking element of the floor panel cooperates with the fourth locking element of the adjacently arranged further floor panel for the purpose of providing a fourth locking in the second direction. It will be understood that also the first core flank can comprise the fourth locking element and the second outer side flank can comprise the third locking element. The third locking element may comprise a bulge and the fourth locking element may comprise a recess that is shaped complementarily to the shape of the bulge.

The floor panel can be made from at least one of medium-density fiberboard (MDF), a high-density fiberboard (HDF), and a poly-vinyl-chloride or other suitable polymeric material, although other materials are excluded.

The floor panel of the invention typically has four sides and has a substantially flat lower and upper surface, which surfaces are arranged in parallel. Moreover, the first outer side flank and the second core flank may be flat apart from the first and second locking elements, respectively, and may extend in the second direction.

According to a second aspect, the present invention provides a floor that comprises a plurality of adjacently arranged and coupled floor panels as defined above.

BRIEF DESCRIPTION OF THE DRAWINGS

Further advantages, features and details of the invention are elucidated on the basis of preferred embodiments thereof, wherein reference is made to the accompanying drawings, in which.

DESCRIPTION OF THE INVENTION

Figure 1A:
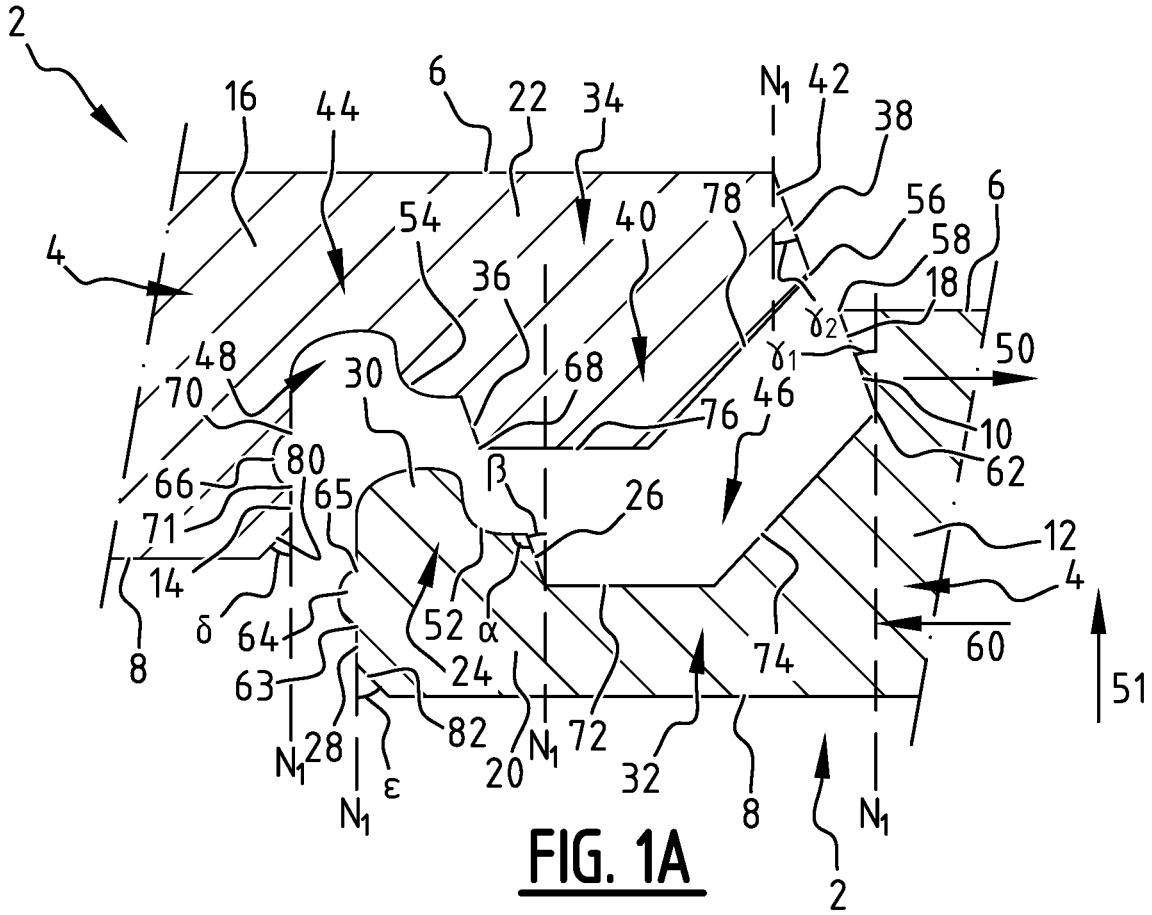
FIG. 1A presents a cross sectional view of a first embodiment of a floor panel in accordance with the present invention arranged next to an identical floor panel in an uncoupled state and FIGS. 1B-1D show the process of coupling these floor panels.

FIG. 1 illustrates two identical floor panels 2 arranged side by side. In this manner, both sides of a single panel can be illustrates in detail. Moreover, both floor panels will be referred to using the same reference number 2.

Floor panel 2 comprises a core 4, a first coupling part 20 and a second coupling part 22, wherein first coupling part 20 is provided at a first side 12 of core 4 and wherein second coupling part 22 is provided at a second side 16 of core 4.

Core 4 of floor panel 2 comprises an upper surface 6, a lower surface 8, a first core flank 10 at first side 12 of core 4, and a second core flank 14 at second side 16 of core 4. First core flank 10 comprises a first core flank upper portion 18 that connects to upper surface 6. Furthermore, first coupling part 20 of floor panel 2 comprises a first tongue 24 and a first bridging part 32, wherein first tongue 24 has a first inner side flank 26, a first outer side flank 28, and a first upper portion flank 30 connecting first inner side flank 26 to first outer side flank 28. First bridging part 32 connects first tongue 24 to core 4.

Second coupling part 22 of floor panel 2 comprises a second tongue 34 and a second bridging part 44, wherein second tongue 34 has a second inner side flank 36, a second outer side flank 38, and a second upper portion flank 40 connecting second inner side flank 36 to second outer side flank 38. Second outer side flank 38 comprises a second outer side flank upper portion 42 that connects to upper surface 6. Furthermore, second bridging part 44 connects second tongue 34 to core 4.

Typically, lower surface 8 and upper surface 6 are substantially flat surfaces. Moreover, upper surface 6 may be provided with decorations that are protected by a protective layer. Floor panel 2 may be arranged on an underlay instead of being arranged on a subfloor directly. Such underlay may improve the thermal insulation of the floor and/or may improve sound isolation.

In the illustrated embodiment, first upper portion flank 30 is curved. Furthermore, second core flank 14 comprises an inclined sub second core flank 80 that extends from second core flank 14 towards lower surface 8 at a fourth angle δ relative to a normal N1 of lower surface 8, wherein the fourth angle is between 0° and 60°. Similarly, first outer side flank 28 comprises an inclined sub first outer side flank 82 that extends from first outer side flank 28 towards lower surface 8 at a fifth angle ε relative to normal N1, wherein the fifth angle is between 0° and 60°.

First bridging part 32 comprises a first bridging flank 72 and a second bridging flank 74. Second upper portion flank 40 comprises a first flank segment 76 and a second flank segment 78. First flank segment 76 is coupled with second inner side flank 36 and second flank segment 78, whereas second flank segment 78 is coupled with second outer side flank 38.

In the illustrated embodiment, first inner side flank 26, first bridging part 32, and first core flank 10 define a first groove 46 and second inner side flank 36, second bridging part 44, and second core flank 14 define a second groove 48. Floor panel 2 is configured to be coupled to an adjacently arranged identical further floor panel in such a manner that first tongue 24 of floor panel 2 is received in second groove 48 of the adjacently arranged further floor panel and that second tongue 34 of the adjacently arranged further floor panel is received in first groove 46 of the floor panel thereby providing a first locking in first direction 50 substantially parallel to upper surface 6. As shown, at least a part of first core flank upper portion 18 of first core flank 10 and at least a part of second outer side flank upper portion 42 of second outer side flank 38 are inclined such that when floor panel 2 is coupled to the adjacently arranged further floor panel, upper portions 18 and 42 against each other for the purpose of providing a second locking in a second direction 51 substantially perpendicular to the upper surface;

In order to couple and lock first coupling part 20 and second coupling part 22, first upper portion flank 30 comprises a curved recess 52 that connects to first inner side flank 26 at a first angle $\alpha$ in between 90° and 150°. First inner side flank 26 extends from curved recess 52 towards first bridging part 32 and towards core 4. Second groove 48 comprises a bulge 54 that is shaped substantially complementarily to curved recess 52 and that is configured such that it is received in curved recess 52 when floor panel 2 is coupled to the adjacently arranged further floor panel. It should be noted that bulge 54 may be omitted or may be shaped to be not or not fully complementary to curved recess 52.

In the illustrated embodiment of floor panel 2, the inclined part of second outer side flank upper portion 42 of second outer side flank 38 comprises a first outer point 56 that is arranged farthest away from a central part of core 4 in first direction 50. The inclined part of first core flank upper portion 18 of first core flank 10 comprises a second outer point 58 that is arranged farthest away from a central part of core 4 in a third direction 60 that is substantially opposite to first direction 50. The inclined part may further comprise an inner point 62 that generally corresponds to that part of the inclined part that is arranged closest to a central part of core 4 when viewed along first direction 50.

First core flank upper portion 18 extends under a third angle $\gamma 1$ relative to normal N1 of lower surface 8 and second outer side flank upper portion 42 extends under a fourth angle $\gamma 2$ relative to normal N1 of the lower surface 8. Both these angles ($\gamma 1$, $\gamma 2$) are in between 0° and 30°.

However, it is preferred that third angle $\gamma 1$ is at least substantially equal to fourth angle $\gamma 2$, and is preferably larger than fourth angle $\gamma 2$ by an angle in between 0° and 5°. In this manner, a clamping action will occur when the adjacently arranged further floor panel 2 is coupled to floor panel 2.

In floor panel 2 of FIG. 1, first inner side flank 26 extends from curved recess 52 towards first bridging part 32 and towards core 4 at a second angle $\beta$ relative to normal N1 of lower surface 8 that is between 0° and 30°. It is preferred that third angle $\gamma 1$ is at least substantially equal to second angle $\beta$, and preferably larger than the second angle $\beta$ by an angle in between 0° and 5°.

To facilitate the abovementioned clamping action, it is preferred that at least part of coupling parts 20, 22 is resilient and/or deformable. For example, first bridging part 32 may be configured to deform slightly to allow first tongue 30 to move away from core 4 to allow second tongue 40 to be inserted into first groove 46.

First outer side flank 28 comprises a first locking element 64 and second core flank 14 comprises a second locking element 66. Locking elements 64, 66 are configured such that when floor panel 2 is coupled to adjacently arranged further floor panel 2, first locking element 64 of floor panel 2 cooperates with second locking element 66 of adjacently arranged further floor panel 2 for the purpose of providing a third locking in second direction 51.

Figure 1B:
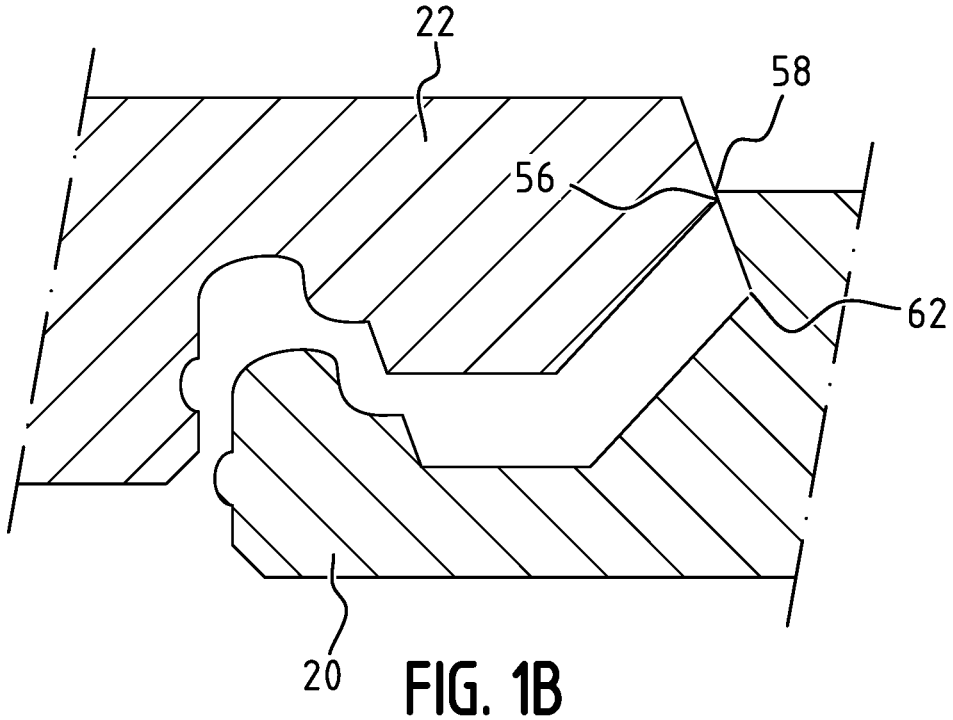
Figure 1C:
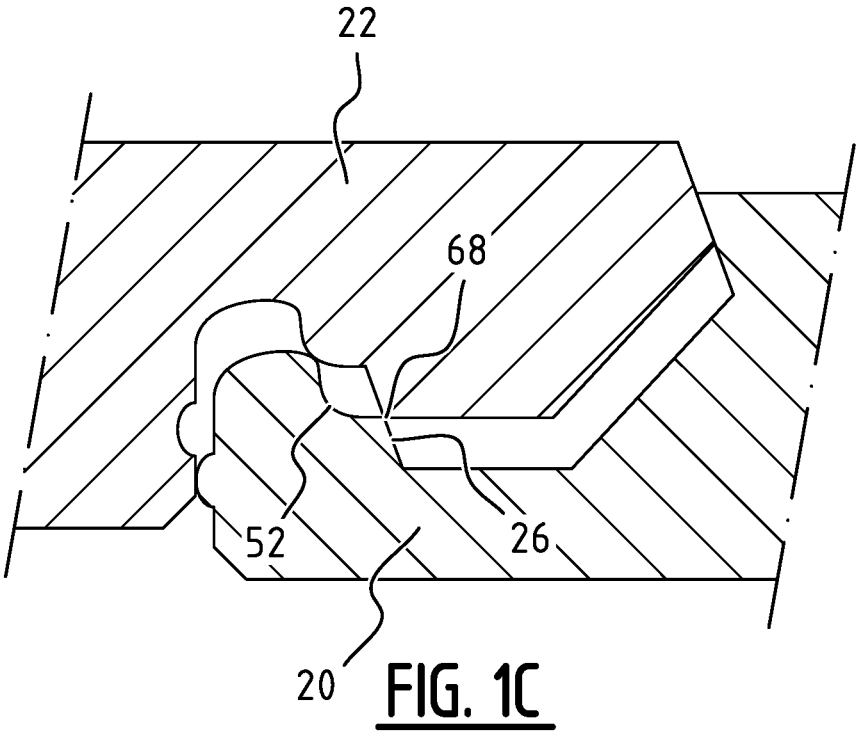
Figure 1D:
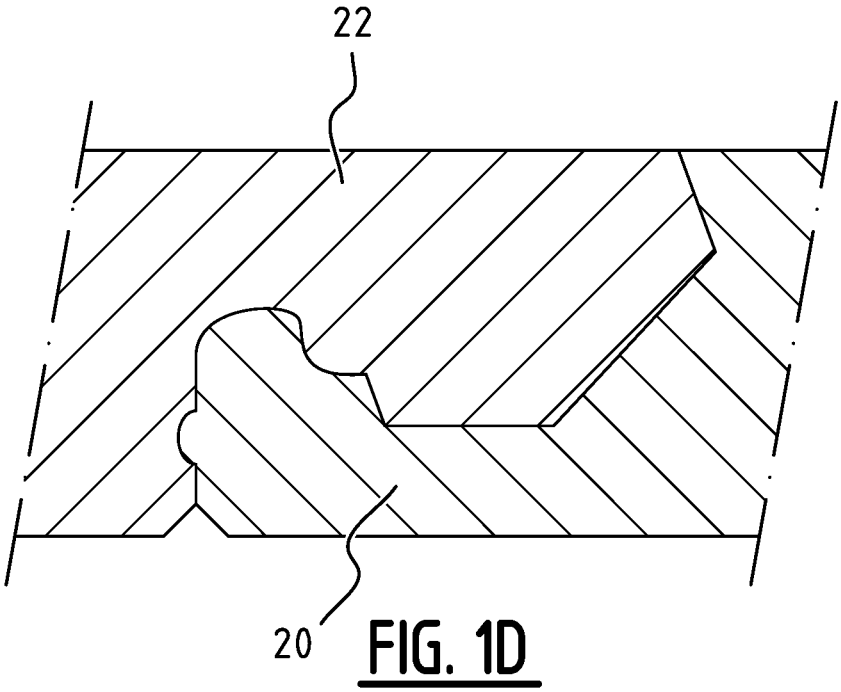

Furthermore, floor panel 2 is configured such that when second upper portion flank 40 of the second tongue 34 of adjacently arranged further floor panel 2 is arranged in curved recess 52 of the floor panel 2 prior to coupling floor panel 2 to adjacently arranged further floor panel 2 and is moved in first direction 50, first outer point 56 of adjacently arranged further floor panel 2 slides underneath the second outer point 58 of floor panel 2 towards inner point 62 of floor panel 2. This is illustrated in FIGS. 1B-1D. As illustrated, first outer point 56 is guided by first core flank upper portion 18 during the final stage of coupling floor panel 2 to further floor panel 2.

First locking element 64 extends in second direction 51 from a first locking element start part 63 up to a second locking element end part 65. Similarly, second locking element 66 extends in second direction 51 from a second locking element start part 71 up to a second locking element end part 70. Second inner side flank 36 comprises a second inner side flank end 68 at which second inner side flank 36 is coupled to second upper portion flank 40.

Second locking element end part 70 and second inner side flank end 68 are preferably at a substantially equal distance to upper surface 6.

As shown in FIG. 1C, during the abovementioned sliding movement, second inner side flank 36 is guided by first inner side flank 26. Moreover, prior to pushing further floor panel 2 downward to enable it to be coupled to floor panel 2, second inner side flank end 68 rests on curved recess 52. This is illustrated in FIG. 1C. This resting position can be identified by the user as he will notice a slight vertical drop when aligning floor panel 2 and further floor panel 2. At this moment, first outer point 56 is or has already moved underneath second outer point 58. Consequently, when the user uses increased force, for example to enable the clamping action, damage to points 56, 58 can be avoided. Hence, the present invention allows delicate structures of floor panel 2, such as points 56, 58, to be protected during the final stages of floor panel coupling.

Figure 2A:
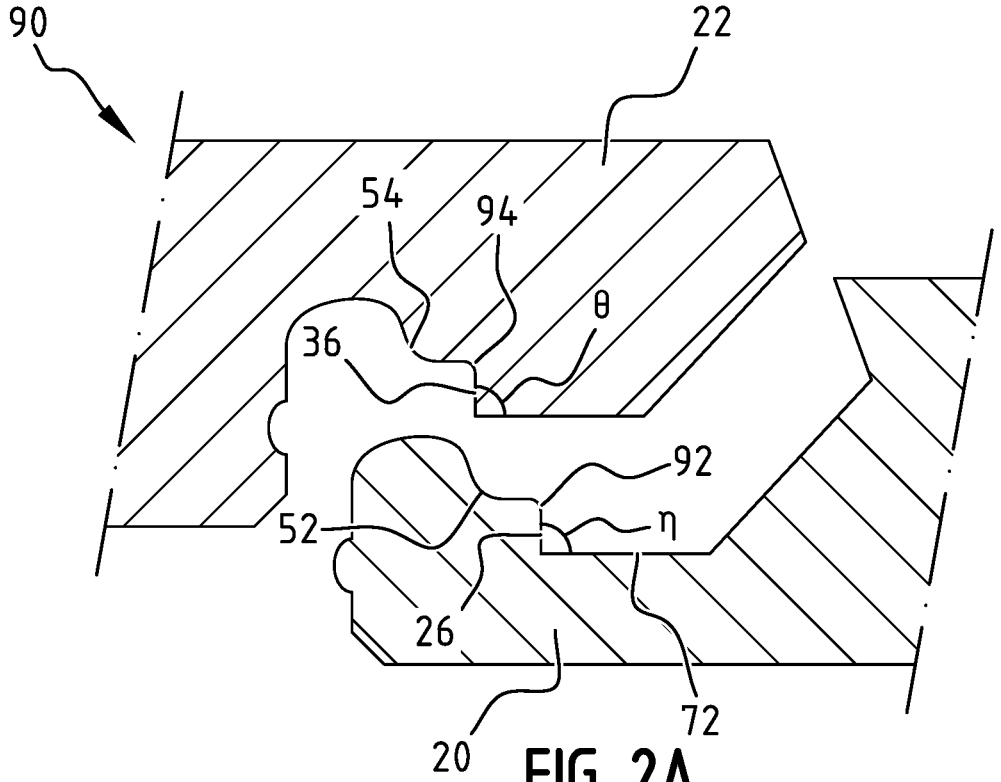
FIGS. 2A and 2B illustrate a second embodiment of a floor panel in accordance with the present invention in an uncoupled and coupled state, respectively.
Figure 2B:
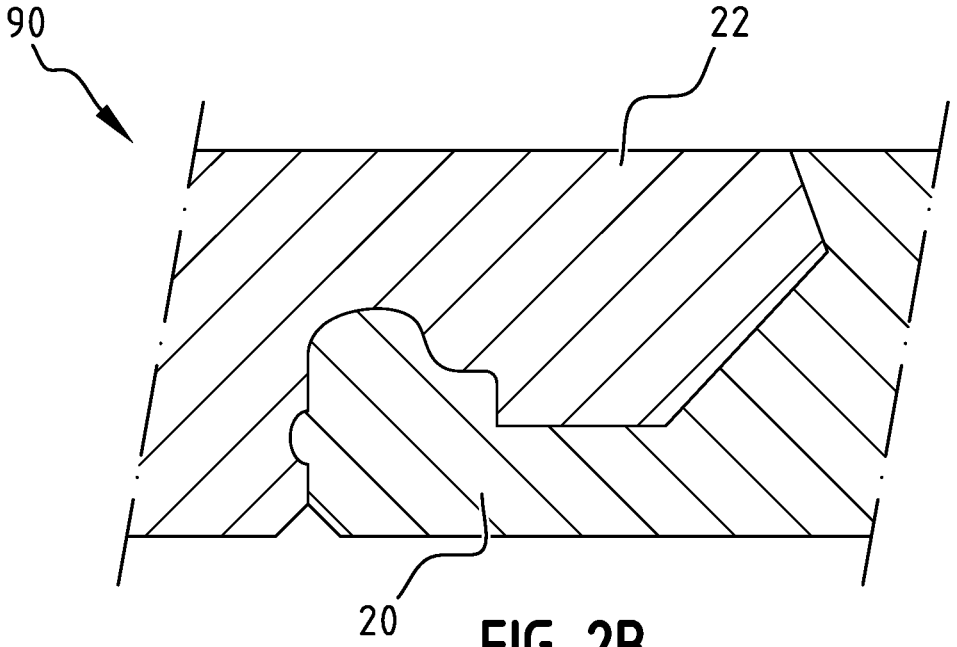

FIG. 2A illustrates a further embodiment of a floor panel 90 in accordance with the present invention, and FIG. 2B illustrates how floor panel 90 can be coupled to an identical further floor panel 90. In this alternative embodiment, first inner side flank 26 is configured at an angle $\eta$, wherein angle $\eta$ is between 90° and 120°. In this embodiment angle $\theta$ is 90° and angle $\theta$ is complement to angle $\eta$. In other embodiments, angle $\theta$ is larger than second angle $\eta$ by an angle in between 0° and 5°. Also in this manner, a clamping action can be obtained.

First inner side flank 26 is connected to curved recess 52 by curved recess end 92. The illustrative embodiment shows that curved recess end 92 can be slightly curved. Bulge end 94 may have a shape that is complementary to the shape of curved recess end 92.

Figure 3A:
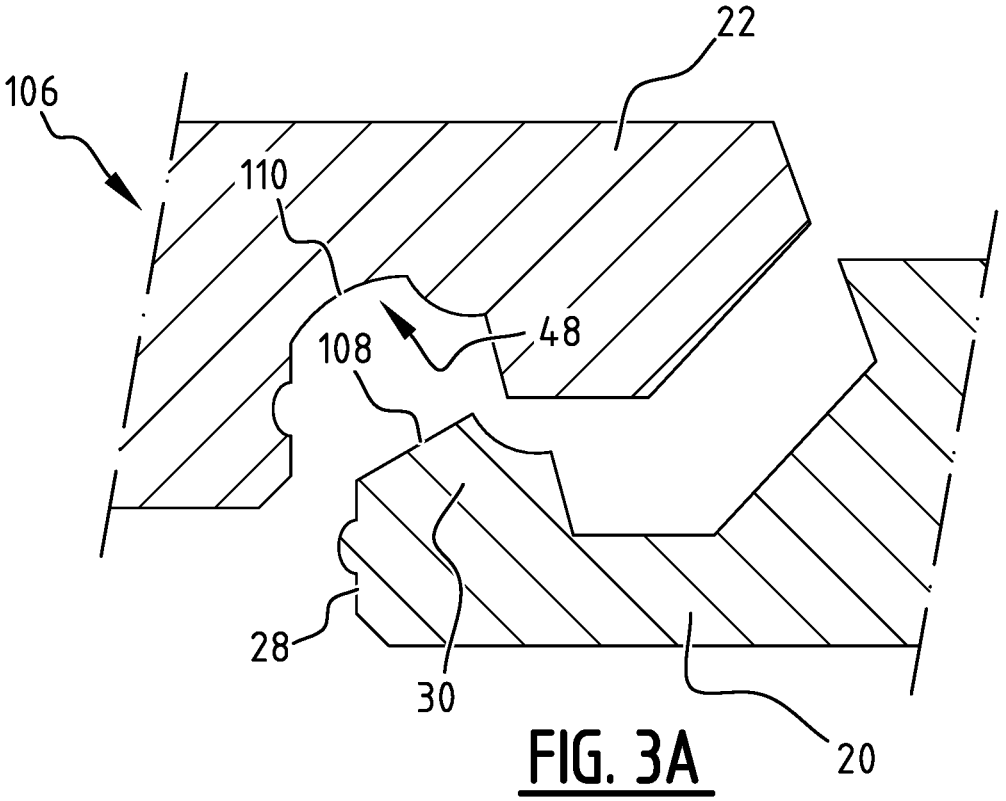
FIGS. 3A and 3B illustrate a third embodiment of a floor panel in accordance with the present invention in an uncoupled and coupled state, respectively.
Figure 3B:
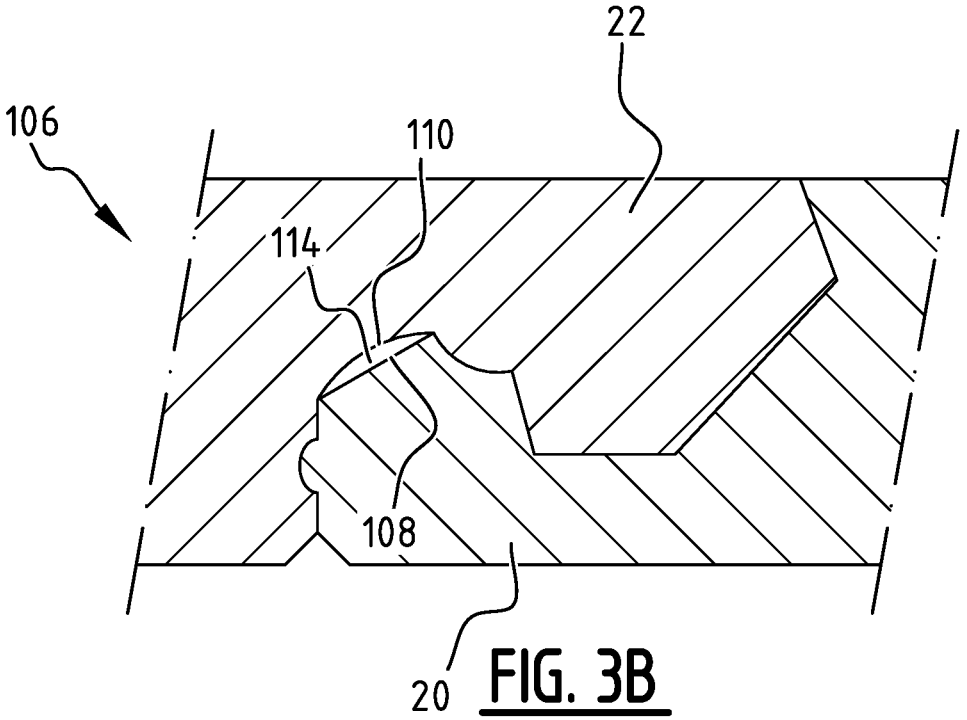
Figure 4A:
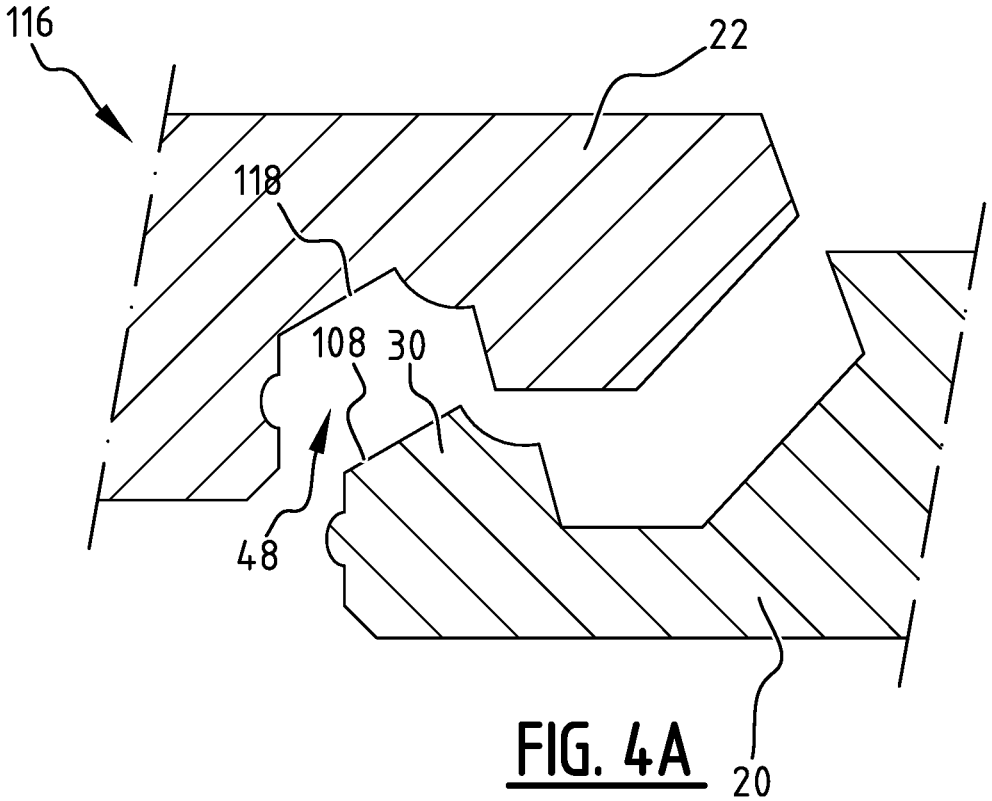
FIGS. 4A and 4B illustrate a fourth embodiment of a floor panel in accordance with the present invention in an uncoupled and coupled state, respectively.
Figure 4B:
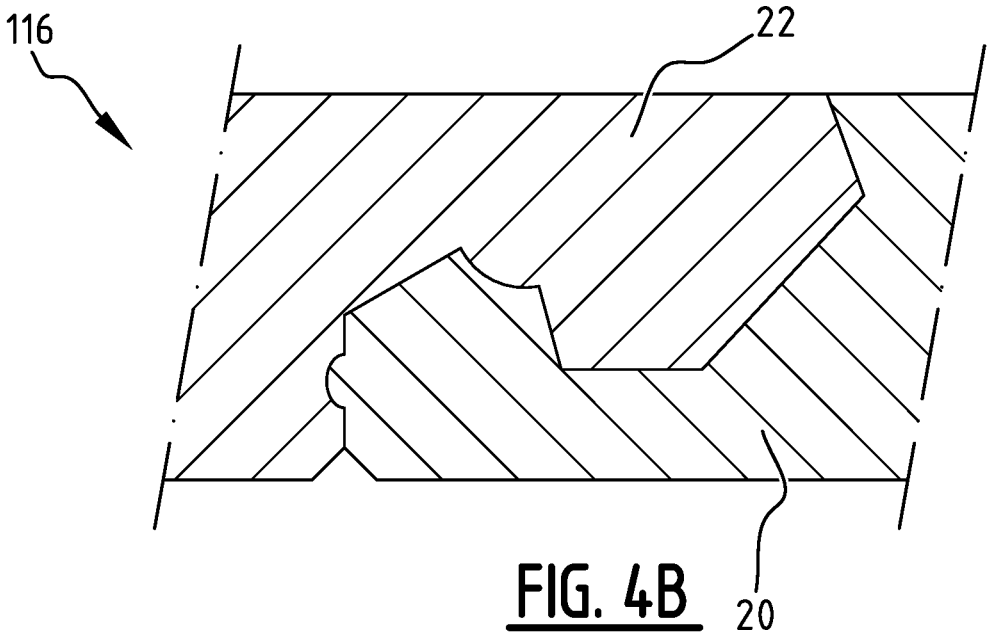

FIG. 3A illustrates a floor panel 106 in which second groove 48 comprises a curved portion 110. Furthermore, first upper portion flank 30 comprises a flat flank 108 that is coupled to curved recess 52 and first outer side flank 28. In the coupled state, shown in FIG. 3B, a space 114 can be identified between curved portion 110 and flat flank 108. Space 114 could for example be used to collect debris that would otherwise disturb the coupling between floor panels 2. However, as shown in FIGS. 4A and 4B that illustrate a further embodiment of a floor panel 116, curved portion 110 can be replaced by a flat flank 118 such that a space between flat flanks 118, 108 cannot or hardly be identified when the floor panels 2 are coupled.

Figure 5A:
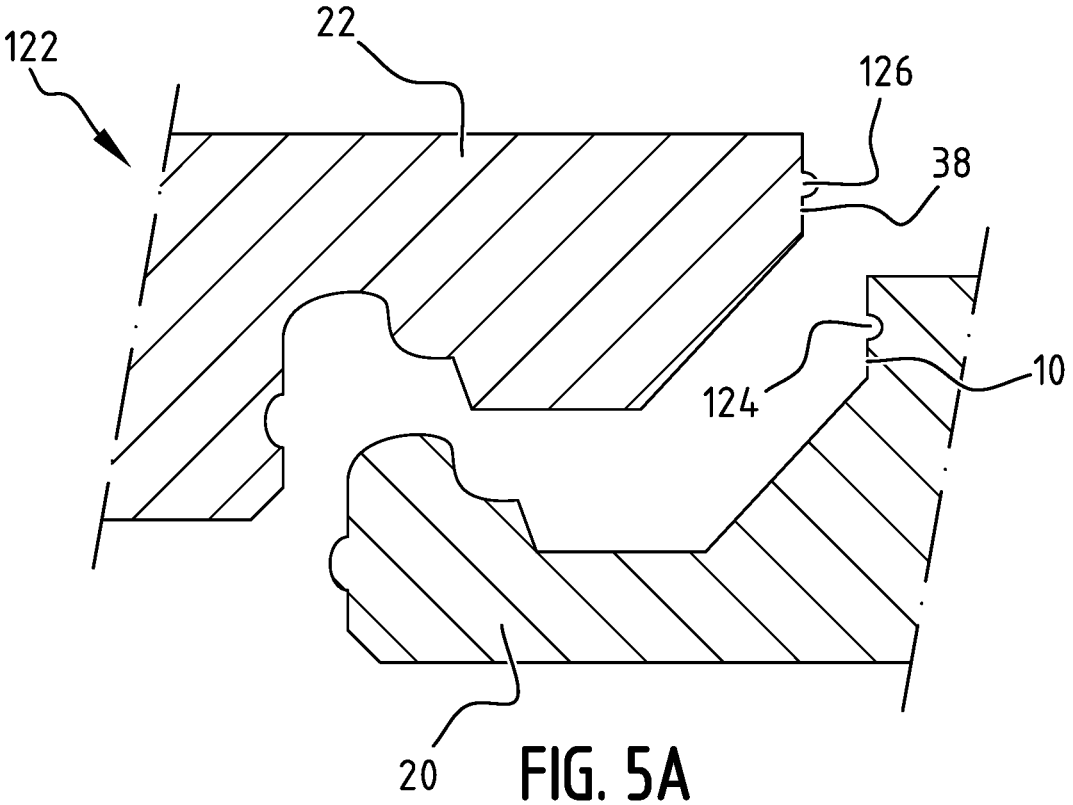
FIGS. 5A and 5B illustrate a fifth embodiment of a floor panel in accordance with the present invention in an uncoupled and coupled state, respectively.
Figure 5B:
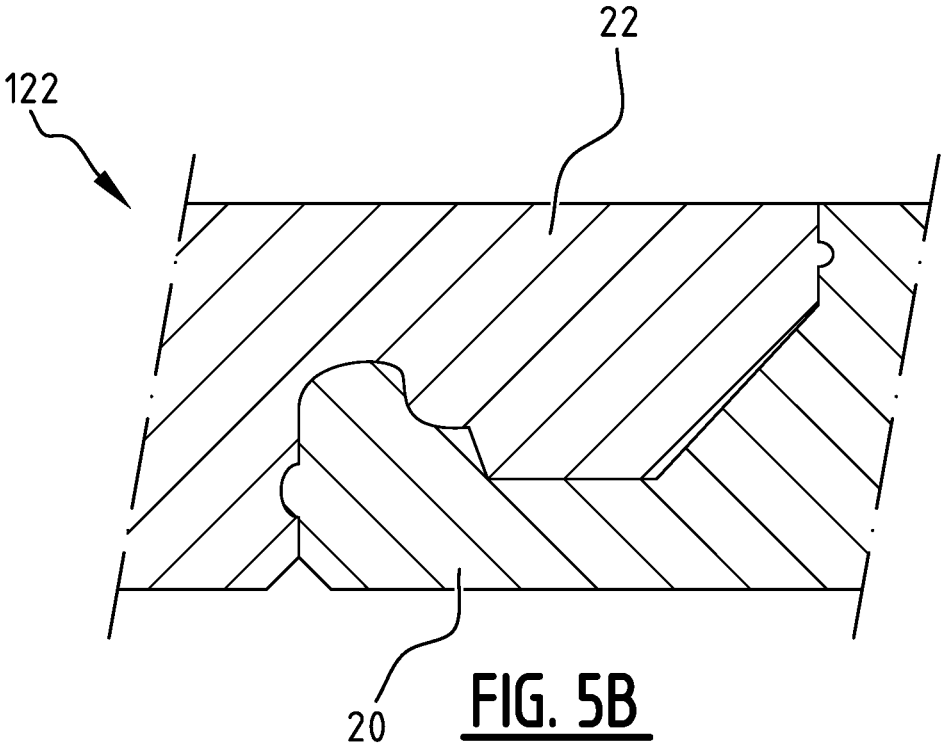

In some cases, a reduced vertical locking would suffice. In such cases, first core flank upper portion 18 and second outer side flank upper portion 42 can be configured substantially parallel to normal N1 as with floor panel 122 shown in FIGS. 5A and 5B. Such embodiment would still benefit from the improved manner in which the floor panels can be aligned prior to providing the relatively strong force to allow the panel to be coupled.

To improve vertical locking, first core flank 10 may comprise a recess 124, wherein recess 124 is preferably a curved recess. Furthermore, second outer side flank 38 may comprise a bulge 126, wherein bulge 126 and recess 124 are complementary with each other. Recess 124 and bulge 126 are examples of cooperating locking elements. The skilled person will readily understand that other locking elements are equally possible.

Figure 6A:
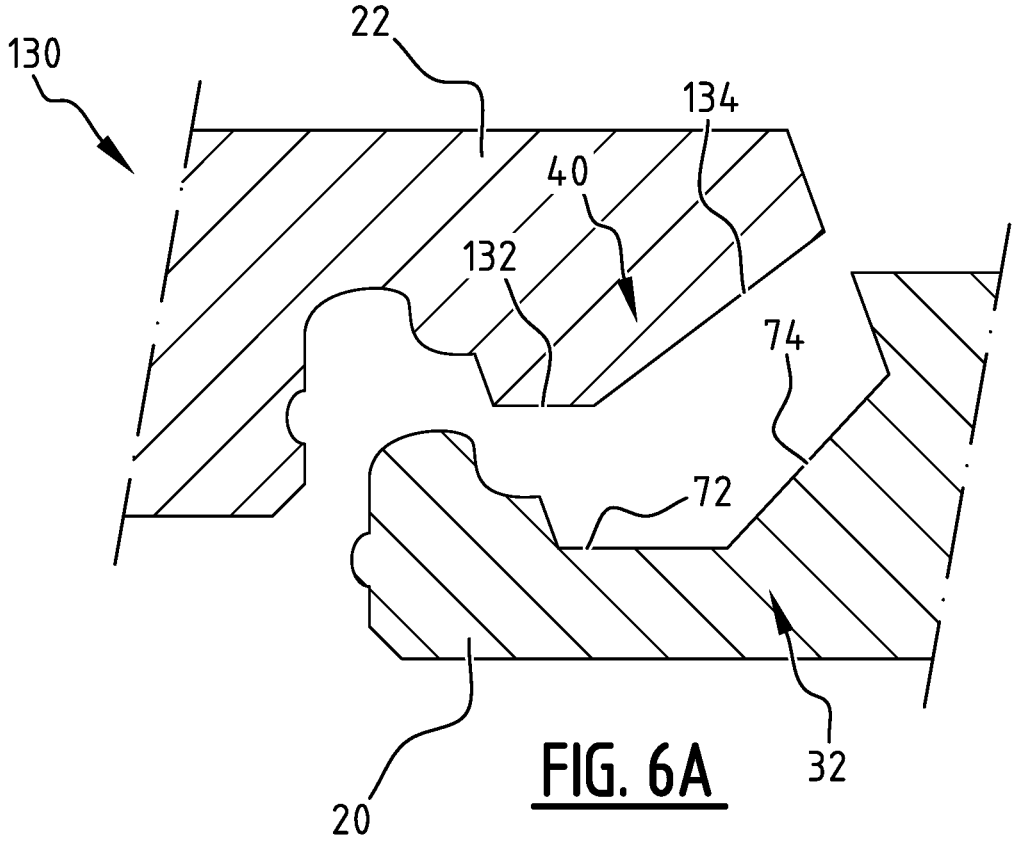
FIGS. 6A and 6B illustrate a sixth embodiment of a floor panel in accordance with the present invention in an uncoupled and coupled state, respectively.
Figure 6B:
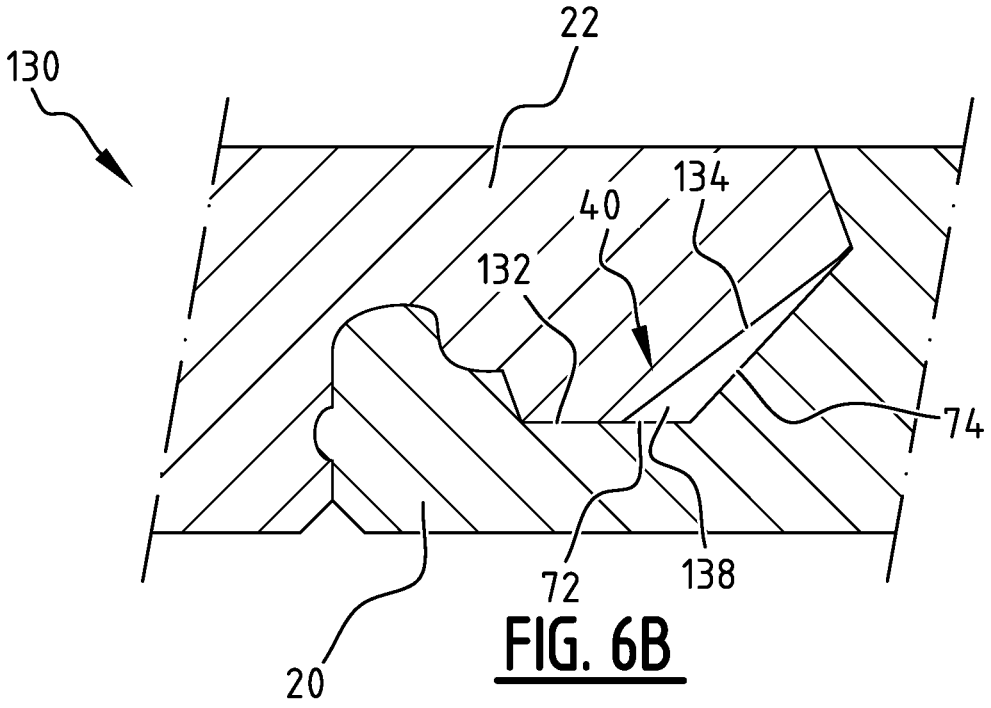

FIG. 6A illustrates a floor panel 130 in which second upper portion flank 40 comprises a first flank segment 132 and a second flank segment 134, wherein first flank segment 132 is substantially parallel to upper surface 6 and second flank segment 134 is substantially flat and configured at an angle compared to flank segment 132. Furthermore, first bridging part 32 comprises a first bridging flank 72 and a second bridging flank 74, wherein first bridging flank 72 is substantially parallel to lower surface 8 and second bridging flank 74 is substantially flat and configured at an angle compared to first bridging flank 72. In the coupled state, shown in FIG. 6B, it can be seen that at least a part of first bridging flank 72, second bridge flank 74 and second flank segment 134 define a space 138 that could for example be used to collect debris that would otherwise disturb the coupling between floor panels 2.

Figure 7:
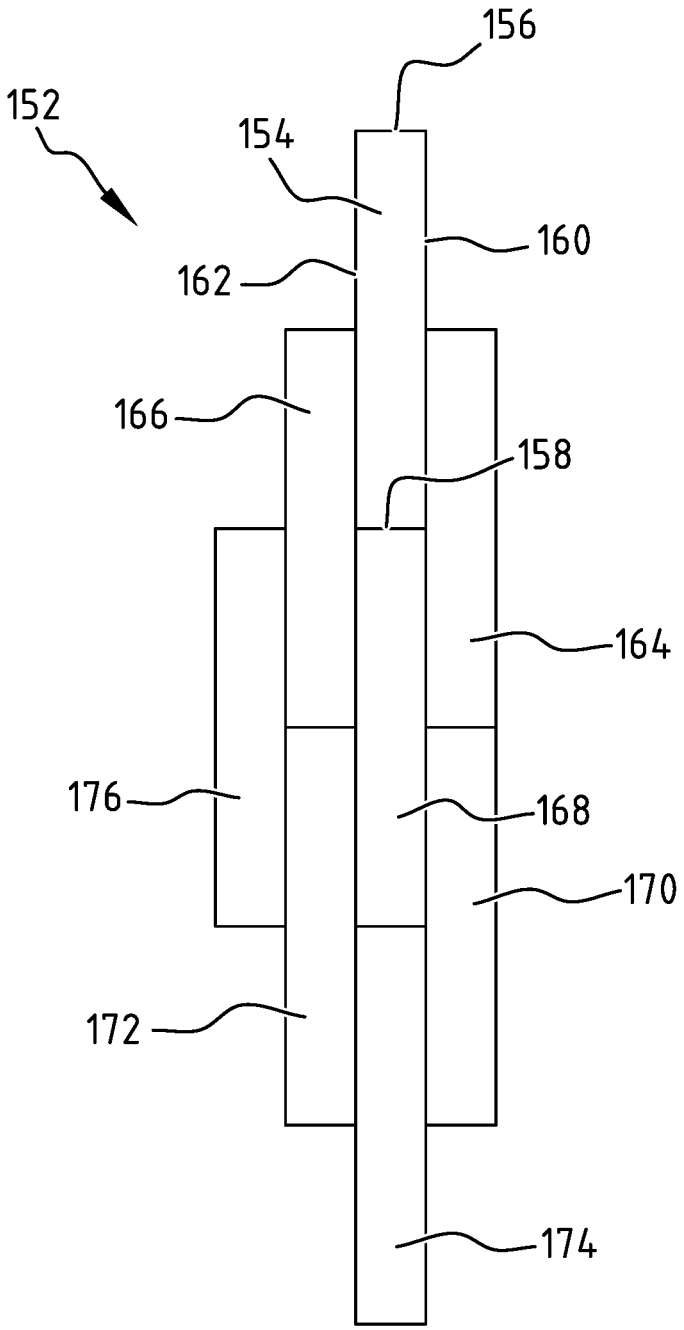
FIG. 7 illustrates a floor in accordance with the invention.

FIG. 7 illustrates a floor 152 comprising coupled identical floor panels 154, 164, 166, 168, 170, 172, 174, 176, wherein each of said floor panels comprises four sides. Each short side 156, 158 is coupled to a short side of an adjacent panel, whereas each long side 160, 162 is coupled to the long sides of two adjacent panels. The coupling between shorts sides and/or the coupling between long sides can be obtained using the first coupling part and second coupling part as described above.

The present invention has been described using detailed embodiments thereof. However, the skilled person will readily understand that the present invention is not limited to these embodiments and that various modifications can be made without departing from the scope of the invention, which is limited by the appended claims and their equivalents.

The invention claimed is:

1. A floor panel, comprising:

a core provided with an upper surface, a lower surface, a first core flank at a first side of the core, and a second core flank at a second side of the core, wherein the first core flank comprises a first core flank upper portion that connects to the upper surface;

a first coupling part and a second coupling part provided at the first side and the second side of the core, respectively;

wherein the first coupling part comprises:

a first tongue having a first inner side flank, a first outer side flank, and a first upper portion flank connecting the first inner side flank to the first outer side flank;

a first bridging part connecting the first tongue to the core;

wherein the second coupling part comprises:

a second tongue having a second inner side flank, a second outer side flank, and a second upper portion flank connecting the second inner side flank to the second outer side flank, wherein the second outer side flank comprises a second outer side flank upper portion that connects to the upper surface;

a second bridging part connecting the second tongue to the core;

wherein the first inner side flank, the first bridging part, and the first core flank define a first groove and wherein the second inner side flank, the second bridging part, and the second core flank define a second groove;

wherein the floor panel is configured to be coupled to an adjacently arranged further floor panel that is identical to said floor panel in such a manner that the first tongue of the floor panel is received in the second groove of the adjacently arranged further floor panel and that the second tongue of the adjacently arranged further floor panel is received in the first groove of the floor panel thereby providing a first locking in a first direction substantially parallel to the upper surface;

wherein at least a part of the first core flank upper portion of the first core flank and at least a part of the second outer side flank upper portion of the second outer side flank are inclined such that when the floor panel is coupled to the adjacently arranged further floor panel these upper portions lie against each other for the purpose of providing a second locking in a second direction substantially perpendicular to the upper surface;

in that the first upper portion flank of the first tongue comprises a curved recess that connects to the first inner side flank at a first angle ($\alpha$) in between 90° and 150°, wherein the first inner side flank extends from the curved recess towards the first bridging part and towards the core, and wherein the second groove comprises a bulge that is shaped substantially complementarily to the curved recess and is configured such that it is received in the curved recess when the floor panel is coupled to the adjacently arranged further floor panel, and wherein the first inner side flank extends from the curved recess towards the first bridging part and towards the core at a second angle relative to a normal of the lower surface that is in between 0° and 45°.

2. The floor panel according to claim 1, wherein the inclined part of the second outer side flank upper portion of the second outer side flank comprises a first outer point that is arranged farthest away from a central part of the core in the first direction, and wherein the inclined part of the first core flank upper portion of the first core flank comprises an inner point, and a second outer point that is arranged farthest away from a central part of the core in a third direction, wherein the third direction is substantially opposite to the first direction;

wherein the floor panel is configured such that when the second upper portion flank of the second tongue of the adjacently arranged further floor panel is arranged in the curved recess of the floor panel prior to coupling said floor panel to said adjacently arranged further floor panel and is moved in the first direction, the first outer point of the adjacently arranged further floor panel slides underneath the second outer point of the floor panel towards the inner point of the floor panel.

3. The floor panel according to claim 2, wherein during the sliding movement of the first outer point of the adjacently arranged further floor panel towards the inner point of the floor panel, the second upper portion flank of the adjacently arranged further floor panel is guided by the first inner side flank of the floor panel, and wherein the floor panel is configured such that when the second upper portion flank of the second tongue of the adjacently arranged further floor panel is arranged in the curved recess of the floor panel just before or at the moment the second upper portion flank will be guided by the first inner side flank of the floor panel, the bulge of the adjacently arranged further floor panel is guided by the curved recess of the floor panel.

4. The floor panel according to claim 1, wherein the first outer side flank comprises a first locking element and the second core flank comprises a second locking element, wherein the first locking element and the second locking element are configured such that when the floor panel is coupled to the adjacently arranged further floor panel the first locking element of the floor panel cooperates with the second locking element of the adjacently arranged further floor panel for the purpose of providing a third locking in the second direction.

5. The floor panel according to claim 4, wherein the second locking element extends in the second direction from a second locking element start part up to a second locking element end part;

wherein the second inner side flank comprises a second inner side flank end at which the second inner side flank is coupled to the second upper portion flank;

wherein the second locking element end part and the second inner side flank end are at a substantially equal distance to the upper surface; and/or wherein the second core flank further comprises an inclined sub second core flank arranged in between the lower surface and the second locking element start part and extending under a fifth angle relative to a normal of the lower surface, wherein the fifth angle is in between 0° and 60°.

6. The floor panel according to claim 5, wherein the third angle is at least substantially equal to the second angle, and larger than the second angle by an angle in between 0° and 5°.

7. The floor panel according to claim 1, wherein the first core flank upper portion extends under a third angle relative to a normal of the lower surface and wherein the second outer side flank upper portion extends under a fourth angle relative to said normal of the lower surface, wherein both the third and fourth angles are in between 0° and 30°.

8. The floor panel according to claim 7, wherein the third angle is at least substantially equal to the fourth angle, and larger than the fourth angle by an angle in between 0° and 5°.

9. The floor panel according to claim 1, wherein the lengths of the first core flank upper portion, the first inner side flank, the second inner side flank, and the second outer side flank upper portion are substantially equal.

10. The floor panel according to claim 1, wherein the first bridging part comprises at least a first bridging flank and a second bridging flank.

11. The floor panel according to claim 10, wherein the first bridging flank is coupled with the first inner side flank and the second bridging flank, and wherein the second bridging flank is coupled with the first core flank.

12. The floor panel according to claim 10, wherein the first bridging flank and the first flank segment are substantially flat and/or wherein the second bridging flank and the second flank segment are substantially flat.

13. The floor panel according to claim 10, wherein the first bridging flank and the first flank segment are curved and/or wherein the second bridging flank and the second flank segment are curved.

14. The floor panel according to claim 10, wherein the first bridging flank and the first flank segment are complementarily shaped and/or wherein the second bridging flank and the second flank segment are complementarily shaped.

15. The floor panel according to claim 1, wherein the second upper portion flank comprises a first flank segment and a second flank segment, wherein the first flank segment is coupled with the second inner side flank and the second flank segment, and wherein the second flank segment is coupled with the second outer side flank.

16. The floor panel according to claim 1, wherein the curved recess occupies at most half of an entire surface of the first upper portion flank of the first upper tongue.

17. The floor panel according to claim 1, wherein the first upper portion flank further comprises a bulge, a flat flank segment, or a bulge and a flat flank segment.

18. The floor panel according to claim 17, wherein the second groove further comprises a recess and/or a substantially flat flank segment.

19. The floor panel according to claim 18, wherein the bulge and/or substantially flat flank segment of the first upper portion flank and the recess and/or substantially flat flank segment of the second groove are complementarily shaped.

20. The floor panel according to claim 1, wherein the first locking element extends in the second direction from a first locking element start part up to a second locking element end part, wherein the first outer side flank further comprises an inclined sub first outer side flank that is arranged in between the first locking element start part and the lower surface and extends under a sixth angle relative to a normal of the lower surface, wherein the sixth angle is in between 0° and 60°.

21. The floor panel according to claim 1, wherein the first core flank comprises a third locking element and wherein the second outer side flank comprises a fourth locking element, wherein the third locking element and the fourth locking element are configured such that when the floor panel is coupled to the adjacently arranged further floor panel the third locking element of the floor panel cooperates with the fourth locking element of the adjacently arranged further floor panel for the purpose of providing a fourth locking in the second direction.

22. The floor panel according to claim 1, wherein the floor panel is made from at least one of medium-density fiberboard (MDF), a high-density fiberboard (HDF), and a polyvinyl-chloride.

23. A floor comprising a plurality of adjacently arranged and coupled floor panels as defined in claim 1.

* * * * *